US005247711A

United States Patent [19]

Kwon

[11] Patent Number: 5,247,711

[45] Date of Patent: Sep. 28, 1993

[54] BIDET DEVICE

[76] Inventor: Okwang Kwon, 205 Tenement house, 427-183 Shinjang 1-dong, Hanam-City, Kyonggi-do, Rep. of Korea

[21] Appl. No.: 699,220

[22] Filed: May 13, 1991

[30] Foreign Application Priority Data

May 14, 1990 [KR] Rep. of Korea ..... 90-6813

[51] Int. Cl.[5] ..... E03D 9/08; A47K 3/20

[52] U.S. Cl. ..... 4/420.4; 4/447

[58] Field of Search ..... 4/420.4, 420.1–420.5, 4/443–448, 420.2, 420.3, 445, 446

[56] References Cited

U.S. PATENT DOCUMENTS

| | | | |
|---|---|---|---|
| 1,855,008 | 4/1932 | Callejo | 4/420.5 |
| 3,570,015 | 3/1971 | Rosengaus | 4/420.4 |
| 4,041,553 | 8/1977 | Sussman | 4/447 |
| 4,068,325 | 1/1978 | Benthin | 4/420.4 |
| 4,094,018 | 6/1978 | Bemthin | 4/420.4 |
| 4,242,764 | 1/1981 | Fukuda | 4/420.4 |
| 4,553,274 | 11/1985 | Yui | 4/420.4 |
| 4,597,111 | 7/1986 | Hirashiba et al. | 4/420.4 |
| 4,953,238 | 9/1990 | Shifferly | 4/420.4 X |
| 4,995,121 | 2/1991 | Barker | 4/420.4 X |
| 5,101,520 | 4/1992 | Lockhart | 4/420.4 X |

FOREIGN PATENT DOCUMENTS

| | | | |
|---|---|---|---|
| 0037308 | 11/1930 | France | 4/420.4 |
| 2142054 | 1/1985 | United Kingdom | 4/420.4 |

*Primary Examiner*—William A. Cuchlinski, Jr.
*Assistant Examiner*—John L. Beres
*Attorney, Agent, or Firm*—McGlew and Tuttle

[57] ABSTRACT

A bidet device comprising a stationary pipe provided with a water inlet pipe and three nozzles arranged to be spaced from one another. The bidet device also comprises a rotatable actuating pipe adapted to change water ejecting directions of the nozzle. The actuating pipe has a magnetic rotation preventing member which cooperates with the other magnetic rotation preventing member provided at the stationary pipe, so as to maintain the nozzle at their changed positions. A valve and a valve seat are also provided for controlling water supply to two nozzles, irrespective of the remaining nozzle.

5 Claims, 7 Drawing Sheets

FIG. 5A(1)

FIG. 5B
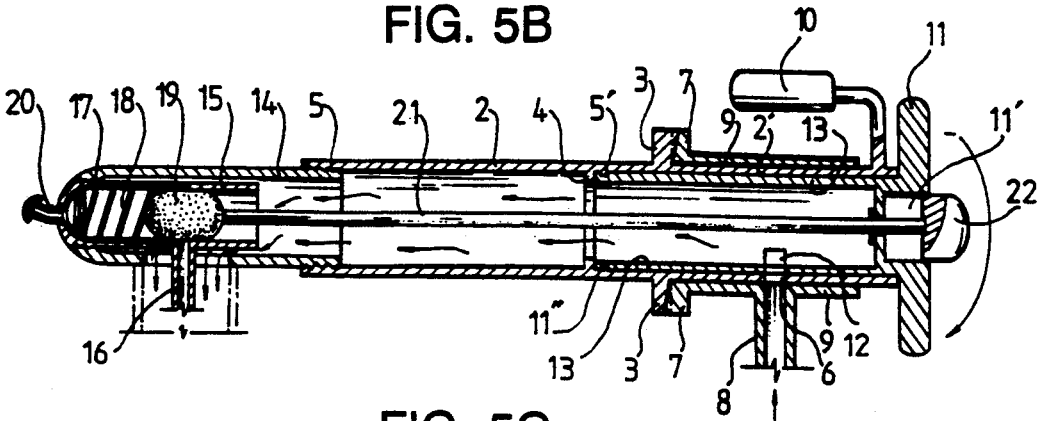
FIG. 5C
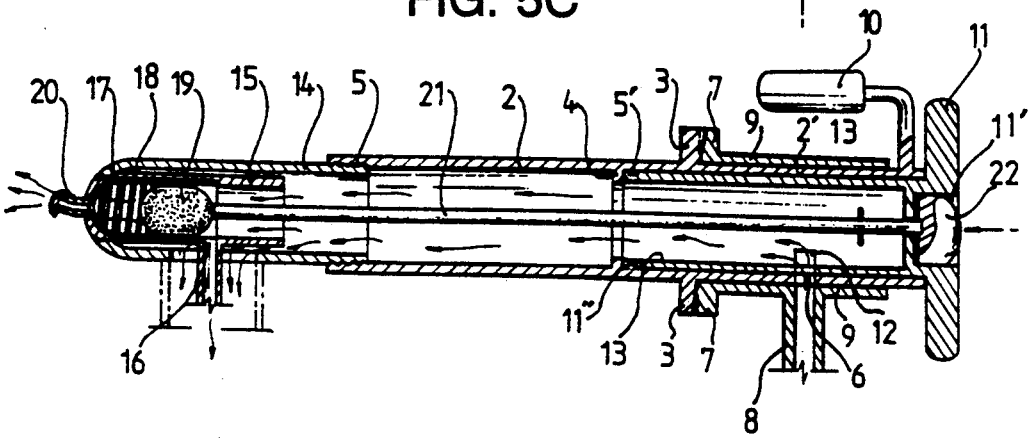
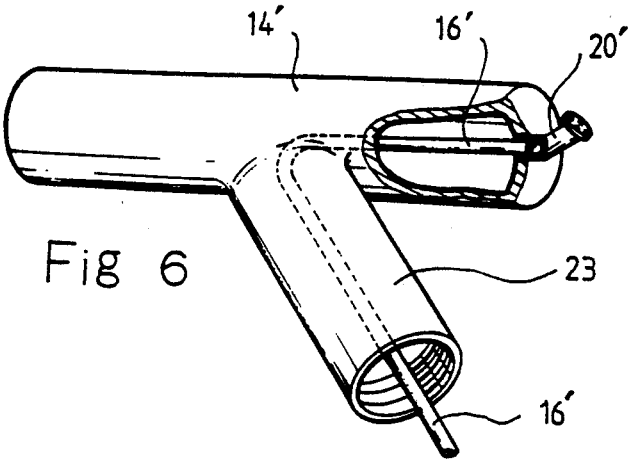
Fig 6

BIDET DEVICE

BACKGROUND OF THE INVENTION

1. Field of the Invention

The present invention relates generally to a sanitary device for washing the lower parts of the human body, and more particularly to a bidet device which provides the access of a free ranging nozzle to direct the waterstream to any desired human body location.

2. Description of the Prior Art

Sanitary cleansing device for washing the anal and genital regions of the human body is an accepted part of ordinary personal hygiene in many parts of the world.

In a conventional washing device of this kind, commonly known as bidet, a nozzle for ejecting water is fixedly disposed at the front inside the toilet bowl in such a way that the water ejected from the nozzle is caused to bathe the female genitals. Also, the water may be added with an optimum quantity of hygienic cleansing materials as occasion demands.

Additionally, there has been proposed a bidet device which is capable of bathing the female genitals and also washing the anal area after defecation.

However, the conventional bidet devices of these kinds have several drawbacks as described hereinafter.

First, in the bidet device with a nozzle fixedly disposed at the front inside the toilet bowl, the bidet device can only provide an usually fixed direction and angle of the ejection, thereby causing the user to move her body in order to adjust the position of the bathing. Hence, the other parts of her body which are not the object of the washing may be subject to being splashed with the water. Furthermore, the bidet device of this style is only for female genitals so that it is not possible to wash the anal area after defecation.

Also, because the bidet device of this style is fixedly disposed in the toilet bowl of the earthenware type, there are difficulties and expenses in manufacture thereof, thereby causing the manufacturer and the consumer to be imposed with a burden. Additionally, it is very difficult to amend the bidet device of this style in case of breakdown or trouble, thus it may be needed to install a new toilet bowl with bidet device causing an additional installing cost which buyers thereof may not be willing to undertake.

Second, in the bidet device with a nozzle disposed separately or connected to a separate water pipe in order to be positioned at the center of the toilet bowl, and a lever movable frontwards and rearwards for controlling the movement of the nozzle in order to bath the female genitals and also wash the anal area after defecation, the direction of the water ejection can not be controlled frontwards and rearwards, but leftward and rightward, thereby causing the efficient washing corresponding to the bent torso of a person not to be obtained. Furthermore, the water ejected from the nozzle of the bidet device of this style is always ejected perpendicularly so that the ejection angle can not controlled. Hence, the water may be concentrated at a certain area of the human body.

Also, in the bidet device of the second style, the feculence may be dropped from the anal area onto the nozzle during the washing resulting in the pollution of the water ejected from the tip. The feculence dropped onto the nozzle, furthermore, give rise a difficult and troublesome work to remove them.

SUMMARY OF THE INVENTION

It is, accordingly, an object of the present invention to provide a bidet device which is detachably attached to the toilet bowl and provides a free control of the nozzles to freely change their water ejecting directions in order to alternatively direct the waterstream to desired human body locations, namely, the female genitals and the anal area.

In accordance with the present invention, the above-mentioned object can be accomplished by providing a bidet device comprising: a stationary pipe fixedly mounted to the seat bottom surface of a toilet bowl and provided with a water inlet pipe connected to a water supply source and communicated with interior of said stationary pipe; an actuating pipe axially extending through the fixed pipe to have ends protruded respectively beyond both ends of the fixed pipe and having a port adapted to communicate interior of said actuating pipe with said water inlet pipe, one of said protruded ends having a lever adapted to rotate said actuating pipe with respect to the fixed pipe; a rotary pipe member axially extending through the actuating pipe and having a blind end protruded beyond said one end of the actuating pipe and a port adapted to communicate interior of said rotary pipe member with the water inlet pipe, said blind end having a knob adapted to rotate the rotary pipe member so as to selectively communicate said port of the rotary pipe member with the water inlet pipe; a first L-shaped elbow connected at one end thereof to the other end of the actuating pipe and provided at the corner thereof with a first nozzle having a tip directed to the outside; an arc-shaped pipe connected at one end thereof to the other end of said elbow and provided at the mediate portion thereof a second nozzle having a tip directed to the outside; a second L-shaped elbow connected at one end thereof to the other end of said arc-shaped pipe and provided at the corner thereof with a third nozzle having a tip directed to the outside, said second elbow being rotatably supported at the other end thereof to the seat bottom surface of the toilet bowl so as to rotate together with said first elbow and arc-shaped pipe according to the rotation of the actuating pipe, thereby causing said nozzle to change their water ejecting directions; valve means for controlling water supply to said first and third nozzles, irrespective of said second nozzle; and means for maintaining the actuating pipe at its rotated position.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIGS. 5 are illustrations of the bidet device of FIG. 2 after being assembled, in which;

FIG. 5A(1) is an enlarged view of the portion of FIG. 5A which is encircled;

FIG. 5B is a longitudinal sectional view showing a water flowing when a handle is shifted to open the flowing system;

FIG. 5C is a longitudinal sectional view showing a water flowing when a button is pressed in the state of FIG. 5B;

FIG. 6 is an exploded and partially broken perspective view of other L-shaped elbow of the bidet device of FIG. 1;

DETAILED DESCRIPTION OF THE PREFERRED EMBODIMENTS

Figure 1:
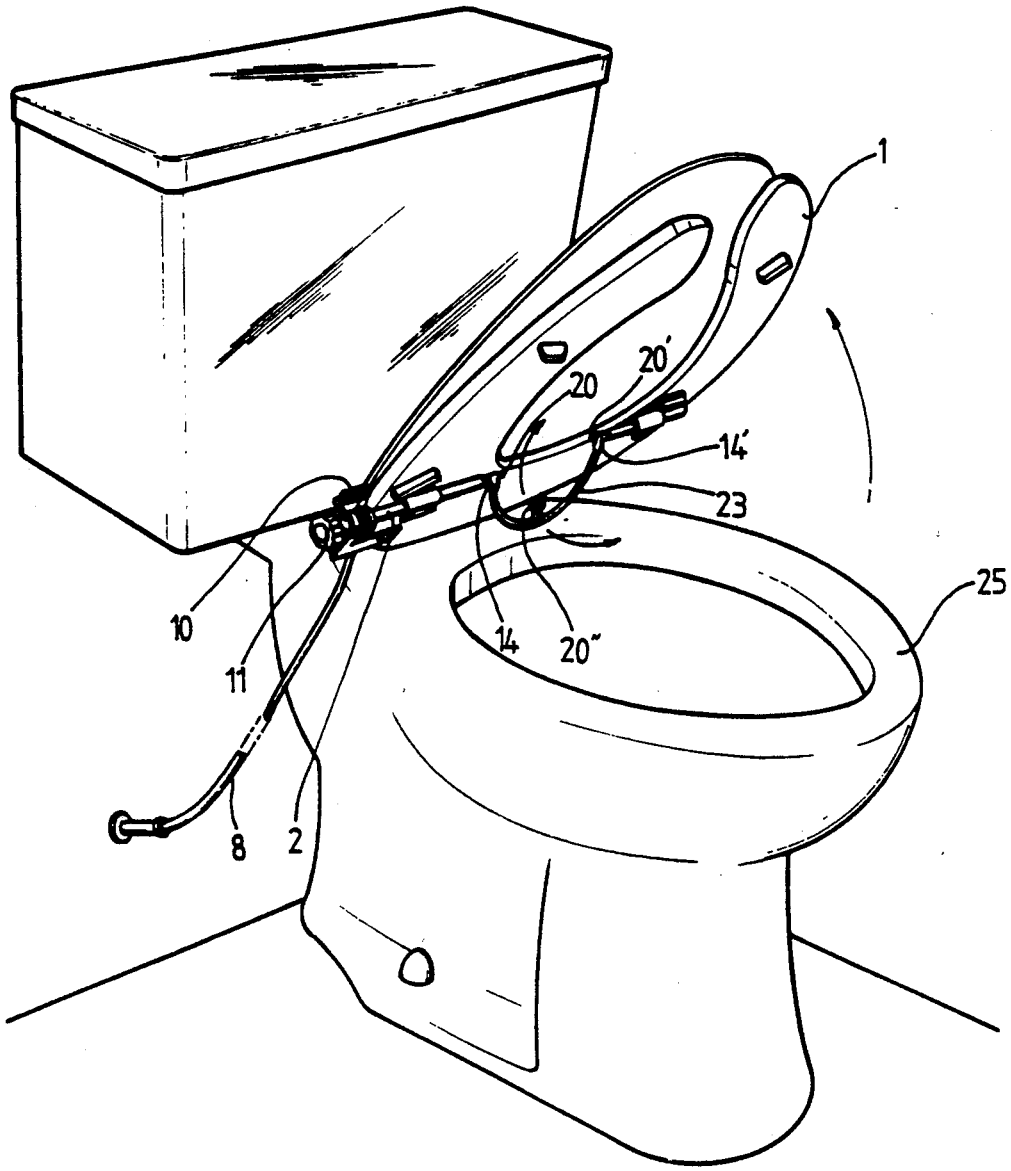
FIG. 1 is a perspective view of a toilet bowl with an embodiment of a bidet device in accordance with the invention.
Figure 2:
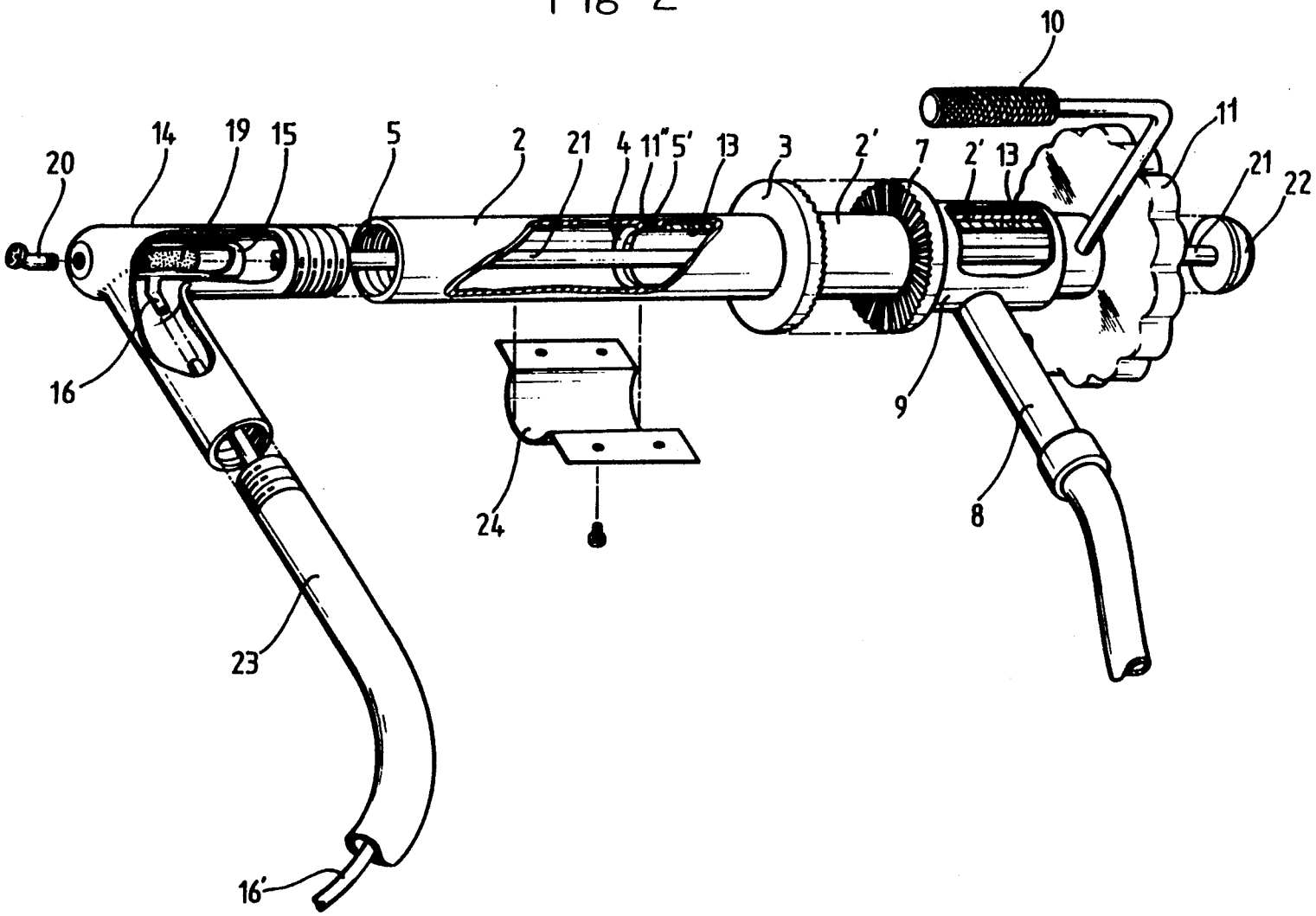
FIG. 2 is an exploded and partially broken perspective view of the bidet device of FIG. 1.
Figure 3:
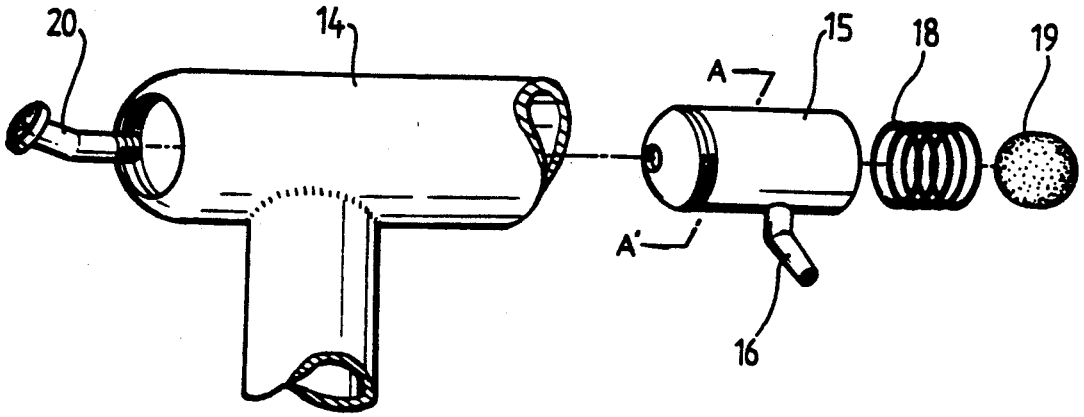
FIG. 3 is an exploded perspective view of a L-shaped elbow of the bidet device of FIG. 2.
Figure 4:
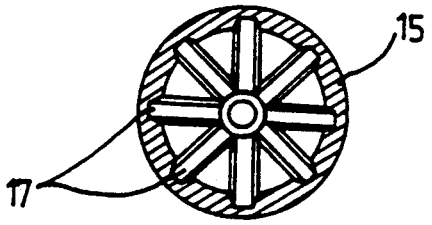
FIG. 4 is a cross sectional view taken on the line A—A' of FIG. 3.
Figure 5A:
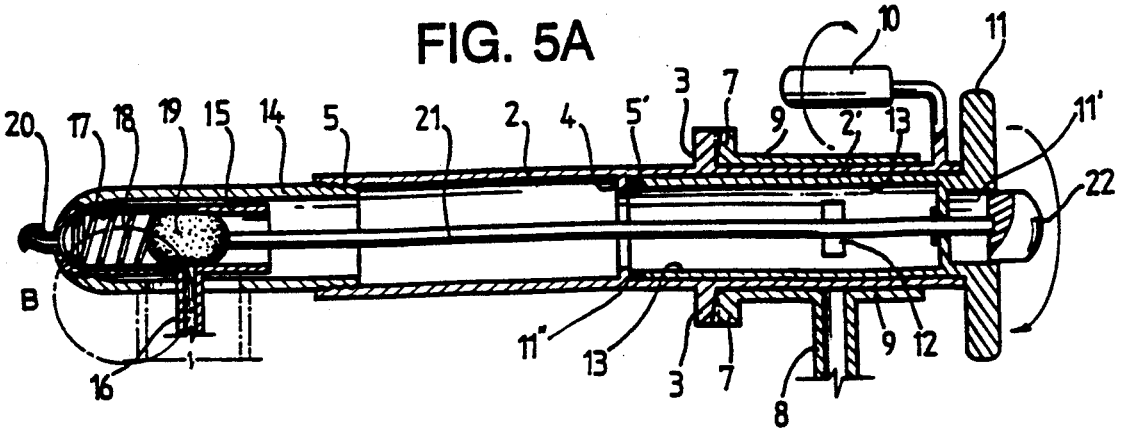
FIG. 5A is a longitudinal sectional view showing the bidet device.
Figure 5A:
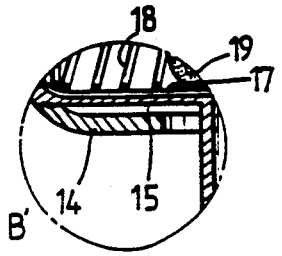

Turning now to FIGS. 1 to 5, a bidet device in accordance with this invention comprises an actuating pipe 2 which is rotatably mounted on the bottom surface of a seat 1 of a toilet bowl 25 with a well-known construction by means of a support bracket 24 the actuating pipe 2 has a magnetic rotation preventing member 3 formed around the outer surface at a mediate portion thereof and is provided with radial teeth formed on its end surface. Inner threads 5 and an inner protruded annular stop 4 are respectively formed on an inside surface of an end portion 2" and an inner mediate surface of the actuating pipe 2. Also, there is provided a stationary pipe 9 which is secured under the seat 1 by means of a securing member, and has a magnetic rotation preventing member 7 formed around an end thereof and adapted for engaging with the rotation preventing member 3. The stationary pipe 9 is connected to a water inlet pipe 8 through which water is supplied from a water reservoir (not shown) thereto. As shown in FIGS. 5, the actuating pipe 2 is provided with a port 6 formed about the other end portion 2' thereof in order to receive water. A lever 10 is mounted to an upper portion of end portions 2'. A rotary pipe member 13 is inserted into the end, portion 21 is provided with the port 6 and the lever 10: rotary pipe member 13 includes a rectangular port 12 for receiving water upon alinement with the port 6. A circular engaging flange 11" is formed on an end in order to engage with an annular engaging protrusion 5' formed on the inner surface of the actuating pipe 2 nearly after the annular stop 4. Also, a knob 11 having a depression 11' formed as depressed at a center thereof is integrally formed at the other end of the rotary pipe member 13. The rotary pipe member 13 can be thus simply rotated inside the actuating pipe 2 by the rotation of the knob 11 thereof, thereby causing ports 6 and 12 to be selectively aligned with each other.

The actuating pipe 2 is connected with a L-shaped elbow 14 at the one end 2" by engaging the inner threads 5 thereof with an outer threaded end of the elbow 14. The elbow 14 connects with an other L-shaped elbow 14' by way of an arc-shaped outer pipe 23. There is provided a nozzle 20" mounted at the mediate portion of the arc-shaped outer pipe 23. Enclosed in an end of the L-shaped elbow 14 is a valve seat pipe 15 provided with a plurality of distribution grooves 17 formed on inside surface thereof and a nozzle 20 connected to an end thereof. The distribution grooves 17 are axially formed and spaced apart from one another in order to concentrate on a center opening of the one end of the valve seat pipe 15, which opening communicates with the nozzle 20. Thus, the grooves 17 communicate with the nozzle 20. Also, the valve seat pipe 15 connects with an arc-shaped connection pipe 16 which is enclosed in the arc-shaped outer pipe 23 and connects to a third nozzle 20' mounted at the other L-shaped elbow 14'.

There is provided a valve which extends from the valve seat pipe 15 to the depression 11' of the knob 11 and comprises a packing formed from a cork packing 19, a push button 22 and a valve stem 21 for connecting the packing 19 and the push button 22. The valve is biased by a compression coil spring 18 positioned between the one inner end of the valve seat pipe 15 and the packing 19. The valve can, therefore, control the water flowing in order to selectively eject water from the nozzles 20, 20' and 20".

The operation of the above-mentioned bidet device according to this invention will be described as follows.

In operation, the knob 11 is rotated so that the port 12 of the rotary pipe member 13 is aligned with the port 6 of the actuating pipe 2 in order to communicate therebetween. Thereafter, the lever 10 is rotated in order to rotate the L-shaped elbows 14 and 14' and the arc-shaped outer pipe 23, so that the elbows 14 and 14' and the pipe 23 can be located at a desired position. Thus, the nozzles 20, 20' and 20" are also located at a desired position of the washing. Also, the magnetic rotation preventing member 3 fixedly contacts with the magnetic rotation preventing member 7 by the magnetic and frictional power therebetween, thereby causing the ejecting position of the nozzles 20, 20' and 20" to be maintained. At this time, if the cork packing 19 is located at the position shown in FIG. 5A, the water received by the port 6 communicating with the port 12 will be ejected through the nozzle 20". Therefore, when the arc-shaped outer pipe 23 is located in the front position, the nozzle 20" will eject the water to the female genitals.

Figure 7:
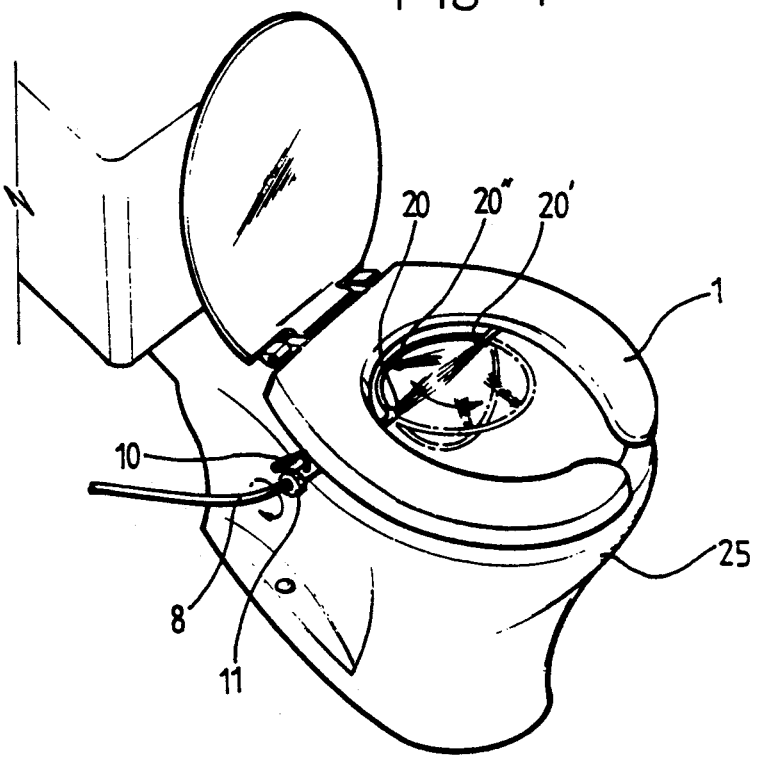
FIG. 7 is a perspective view illustrating the operation of the bidet device of FIG. 1.

On the other hand, upon pushing the push button 22 of the valve, the valve stem 21 moves frontwards to shift the cork packing 19 against the coil spring 18 in order to open the distribution grooves 17 of the valve seat pipe 15 and the arc-shaped inner pipe 16. As a result, the water flows by way of the distribution grooves 17 to eject through the nozzle 20 and also flows by way of the inner pipe 16 in order to eject through the nozzle 20'. At this time, the water is also ejected through the nozzle 20". Hence, in this case, the bidet device ejects the water in three directions as shown in FIG. 7, thereby causing the feculence to be easily removed and to be prevented from being spread out.

Figure 8:
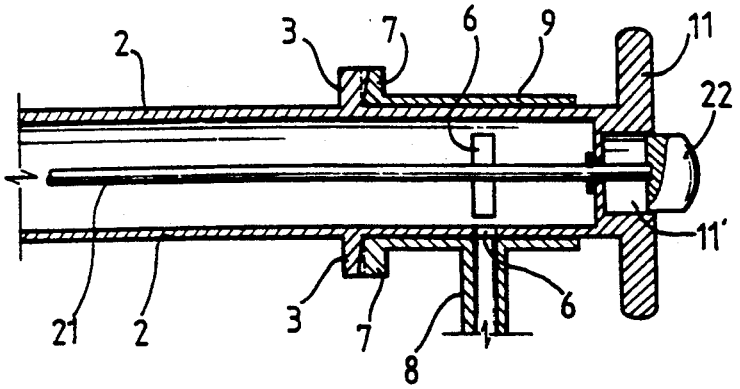
FIG. 8 is a partially longitudinal sectional view of another embodiment of a bidet device in accordance with the present invention.
Figure 9:
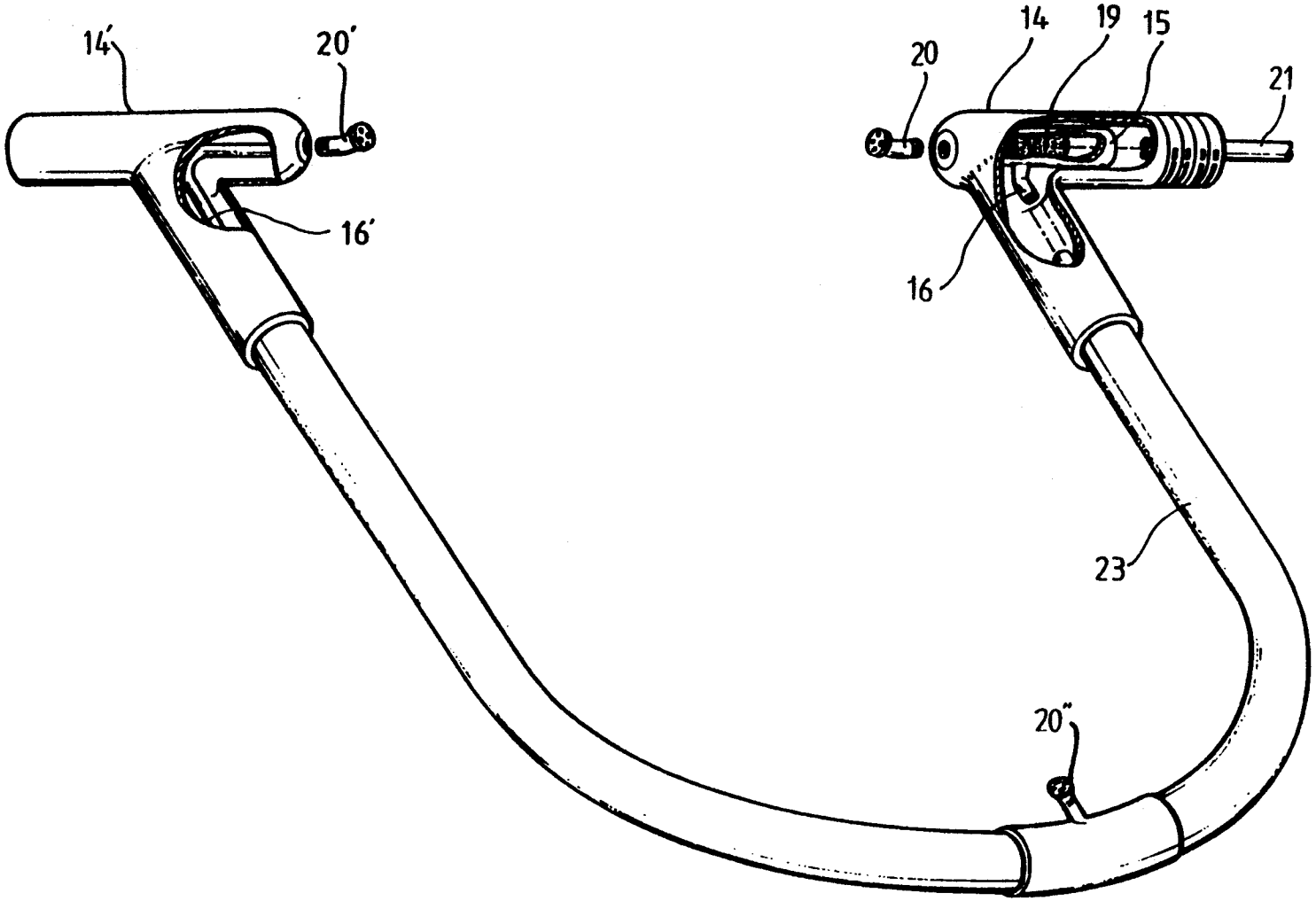
FIG. 9 is a partially broken perspective view illustrating the Bidet Device of FIG. 1.

Additionally, the actuating pipe 2 may be constructed as shown in FIG. 8. In this case, the knob 11 is integrally formed with the actuating pipe 2, so that the lever 10 and the rotary pipe member 13 are not present. Also the alignment of the ports 6 and 12 and the rotation of the arc-shaped outer pipe 23 are carried out by the knob 11.

As above-mentioned, the present invention provides a bidet device capable of ejecting the water in three directions in order to efficiently bathe the female genitals and also wash the anal area after defecation. The bidet device provides advantages that it can be installed to a conventional toilet bowl and easily amended in case of trouble. Furthermore, the bidet device includes three nozzles of which each ejection angle can be easily controlled, thereby causing the human bent trunk to be efficiently washed.

Although the present invention has been described with reference to preferred embodiments, it will be understood that the invention is not limited to the details thereof. Many substitutions and modifications, a few of which have been noted in the foregoing detailed description, may be made without departing from the spirit and scope of the invention as defined in the appended claims.

What is claimed is:

1. A bidet device comprising:

a stationary pipe fixedly mounted to the seat bottom surface of a toilet bowl and provided with a water inlet pipe connected to a water supply source and communicated with interior of said stationary pipe;

an actuating pipe axially extending through the fixed pipe to have ends protruded respectively beyond both ends of the fixed pipe and having a port adapted to communicate the interior of said actuating pipe with said water inlet pipe, one of said protruded ends having a lever adapted to rotate said actuating pipe with respect to the fixed pipe;

a rotary pipe member axially extending through the actuating pipe and having a blind end protruded beyond said one of said protruded ends of the actuating pipe and a port adapted to communicate the interior of said rotary pipe member with the water inlet pipe, said blind end having a knob adapted to rotate the rotary pipe member so as to selectively communicate said port of the rotary pipe member with the water inlet pipe;

a first L-shaped elbow connected at one end thereof to the other end of the actuating pipe and provided at the corner thereof with a first nozzle having a tip directed to the outside of said corner;

an arc-shaped pipe connected at one end thereof to the other end of said first elbow and provided at the mediate portion thereof with a second nozzle having a tip directed to an inside of said arc-shaped pipe;

a second L-shaped elbow connected at one end thereof to the other end of said arc-shaped pipe and provided at the corner thereof with a third nozzle having a tip directed to the outside of said corner and an inside of said arc-shaped pipe, said second elbow being rotatably supported at the other end thereof to the seat bottom surface of the toilet bowl so as to rotate together with said first elbow and arc-shaped pipe according to the rotation of the actuating pipe, thereby causing said nozzles to change their water ejecting directions;

valve means for controlling a water supply to said first and third nozzles, irrespective of said second nozzle; and means for maintaining the actuating pipe at its rotated position.

2. A bidet device in accordance with claim 1, wherein said valve means comprises a valve seat pipe disposed in said first elbow and connected at one end thereof to said first nozzle, said valve seat pipe having at the inner surface a plurality of grooves axially extending from radially spaced positions on said inner surface respectively and concentrating on the center of said one end of the valve seat pipe, which center is the connection position to the first nozzle, an arc-shaped inner pipe extending through said arc-shaped pipe and having one end connected to the valve seat pipe to be communicated with said grooves and other end connected to said third nozzle, said valve means axially extending from the outside of said blind end of the rotary pipe member through the rotary pipe member and the actuating pipe to the interior of the first elbow and having at one end a push button and at the other end a packing having an outer surface closely in contact with the inner surface of the valve seat pipe, said valve means being axially movable between a position in which said packing prevents the water supply to the grooves and said inner pipe and a position in which the packing allows the water supply to the grooves and said inner pipe, a compression spring biasing the valve means such that packing is maintained and its water supply preventing position.

3. A bidet device in accordance with claim 1, wherein said means for maintaining the actuating pipe at its rotated position comprises a pair of annular magnetic rotation preventing members, one provided at one of said ends of said fixed pipe and other provided at the mediate portion of the actuating pipe, said members having faced surfaces provided with engaging teeth respectively and being in contact with each other, in virtue of their magnetic force.

4. A bidet device in accordance with claim 1, wherein all tips of said nozzles are directed so that waterstreams ejected therefrom can be concentrated on a desired position.

5. A bidet device attachable to a toilet seat, the device comprising:

a fixed pipe fixedly mounted on the toilet seat, said fixed pipe having duct means for supplying fluid;

actuating pipe means rotatably connected to said fixed pipe and for receiving fluid from said fixed pipe;

a first elbow connected to an end of said actuating pipe means, said end being substantially opposite from said fixed pipe, said first elbow receiving fluid from said actuating pipe means;

a first nozzle means positioned at a corner area of said first elbow and for ejecting fluid from said first elbow;

an arc-shaped pipe connected to an end of said first elbow substantially opposite from said actuating pipe means, said arc-shaped pipe receiving fluid from said first elbow;

a second nozzle means positioned at a substantially center portion of said arc-shaped pipe and for ejecting fluid from said arc-shaped pipe;

a second elbow connected to an end of said arc-shaped pipe substantially opposite from said first elbow, said second elbow receiving fluid from said arc-shaped pipe, said second elbow having an end substantially opposite from said arc-shaped pipe, and said end being rotatably mounted on the toilet seat;

third nozzle means positioned at a corner area of said second elbow and for ejecting fluid from said second elbow; and valve means for controlling fluid supply to said first and third nozzle means independent of said second nozzle means.

* * * * *